United States Patent [19]

Wagner

[11] Patent Number: 4,682,471

[45] Date of Patent: Jul. 28, 1987

[54] TURBOCOMPRESSOR DOWNHOLE STEAM-GENERATING SYSTEM

[75] Inventor: William R. Wagner, Los Angeles, Calif.

[73] Assignee: Rockwell International Corporation, El Segundo, Calif.

[21] Appl. No.: 906,680

[22] Filed: Sep. 11, 1986

Related U.S. Application Data

[63] Continuation-in-part of Ser. No. 798,350, Nov. 15, 1985, abandoned, which is a continuation of Ser. No. 591,718, Mar. 21, 1984, abandoned.

[51] Int. Cl.[4] ..... F01K 21/04; E21B 36/00

[52] U.S. Cl. ..... 60/649; 60/670; 60/39.53; 166/59; 166/303

[58] Field of Search ..... 166/59, 303; 60/39.53, 60/39.54, 39.55, 39.56, 39.57, 39.58, 39.59, 649, 670

[56] References Cited

U.S. PATENT DOCUMENTS

| | | | |
|---|---|---|---|
| 1,040,350 | 10/1912 | Keys | 60/39.56 |
| 2,402,803 | 6/1946 | Chandler | 60/39.56 |
| 4,336,839 | 6/1982 | Wagner et al. | 166/59 |
| 4,418,540 | 12/1983 | Kasparian et al. | 60/670 X |
| 4,421,163 | 12/1983 | Tuttle | 166/53 |
| 4,498,542 | 2/1985 | Eisenhawer et al. | 166/303 |

*Primary Examiner*—Allen M. Ostrager

*Attorney, Agent, or Firm*—H. Fredrick Hamann; Harry B. Field; Lawrence H. Ginsberg

[57] ABSTRACT

A downhole steam-generating system in which fuel and compressed air from an air compressor unit 20 are fed to a steam generator 22. Steam and/or combustion products are fed to the turbine 24 from the steam generator 22 and the turbine 24 is used to mechanically drive the air compressor unit 20. After leaving the turbine 24, the turbine output may be scrubbed and the combustion products may be either passed down the borehole with the steam or may be discharged into the atmosphere.

2 Claims, 15 Drawing Figures

ONE-PASS TURBOSTEAM UNIT VARIATIONS ( COMBUSTION GAS-OR COMBUSTION GAS-STEAM DRIVE )

TWO-PASS TURBOSTEAM UNIT VARIATIONS-FIRST PASS TURBINE TAKEOFF
( COMBUSTION GAS DRIVE )

TWO-PASS TURBOSTEAM UNIT VARIATIONS-SECOND PASS TURBINE TAKEOFF
(COMBUSTION GAS DRIVE)

TURBOCOMPRESSOR DOWNHOLE STEAM-GENERATING SYSTEM

This is a continuation-in-part of co-pending application Ser. No. 798,350 filed on Nov. 15, 1985, now abandoned, which was a continuation of Ser. No. 591,718, filed Mar. 21, 1984, now abandoned.

BACKGROUND OF THE INVENTION

1. Field of the Invention

This invention relates to downhole steam-generating systems and especially to turbocharged, downhole, steam-generating systems.

In the following description, the term "downhole" means "within a hole, borehole, well, cavity, etc.." "Uphole" means "outside of a hole, borehole, well, cavity, etc.."

2. Description of the Prior Art

Current oil-field, downhole steam generators are used to provide steam for downhole oil production steaming, for secondary or tertiary oil-field reservoir recovery, for oil shale rock steaming, and for various other steam uses. These steam generators employ very-large-size air compressors used in conjuction with large, slow-speed diesel engines or electric motor drive units to supply compressed air to be burned with fuel in combustor units that convert water into steam. These conventional compressors and drive units involve large capital and maintenance costs, and the use of large separate fuel or electrical supplies for powering the drive unit; they are also non-portable (cannot easily be moved from hole to hole in the field). Moreover, the energy or fuel used to drive the system is largely lost forfurther use in the downhole steaming process.

OBJECTS OF THE INVENTION

An object of the invention is to reduce the amount of fuel used by present steam generating systems, especially those used for downhole applications.

Another object is to reduce the size, complexity and cost of present steam-generating systems, especially those used for downhole applications.

A further object is to provide downhole steam-generator systems that are portable.

Still another object is to improve the thermal efficiency of steam-generator systems, especially those used for downhole applications.

SUMMARY OF THE INVENTION

These and other objects and advantages of the present invention are achieved by utilizing a turbine in a steam-generator system which is powered by the combustor of the steam generator and which mechanically drives the air compressor, thereby eliminating a separate drive system for the air compressor. The turbine can be driven by steam produced by the combustor, or by the steam plus the exhaust products of the combustor, or by the combustion products alone. Since the fluid flow quantity for driving the turbine is large, a low-pressure-ratio turbine (pressure ratios of 1–6) in a small high-speed turbocompressor unit may be employed.

The resulting portable, compact system package is more efficient in a downhole steaming operation because of lower capital costs for the initial equipment and lower fuel operating costs, since the combustor exhaust energy can be used to the fullest extent with little external heat loss, thereby allowing development of a maximum-efficieny downhole steaming operation.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawing are designated by the same reference characters.

DETAILED DESCRIPTION OF THE PREFERRED EMBODIMENTS

Figure 1:
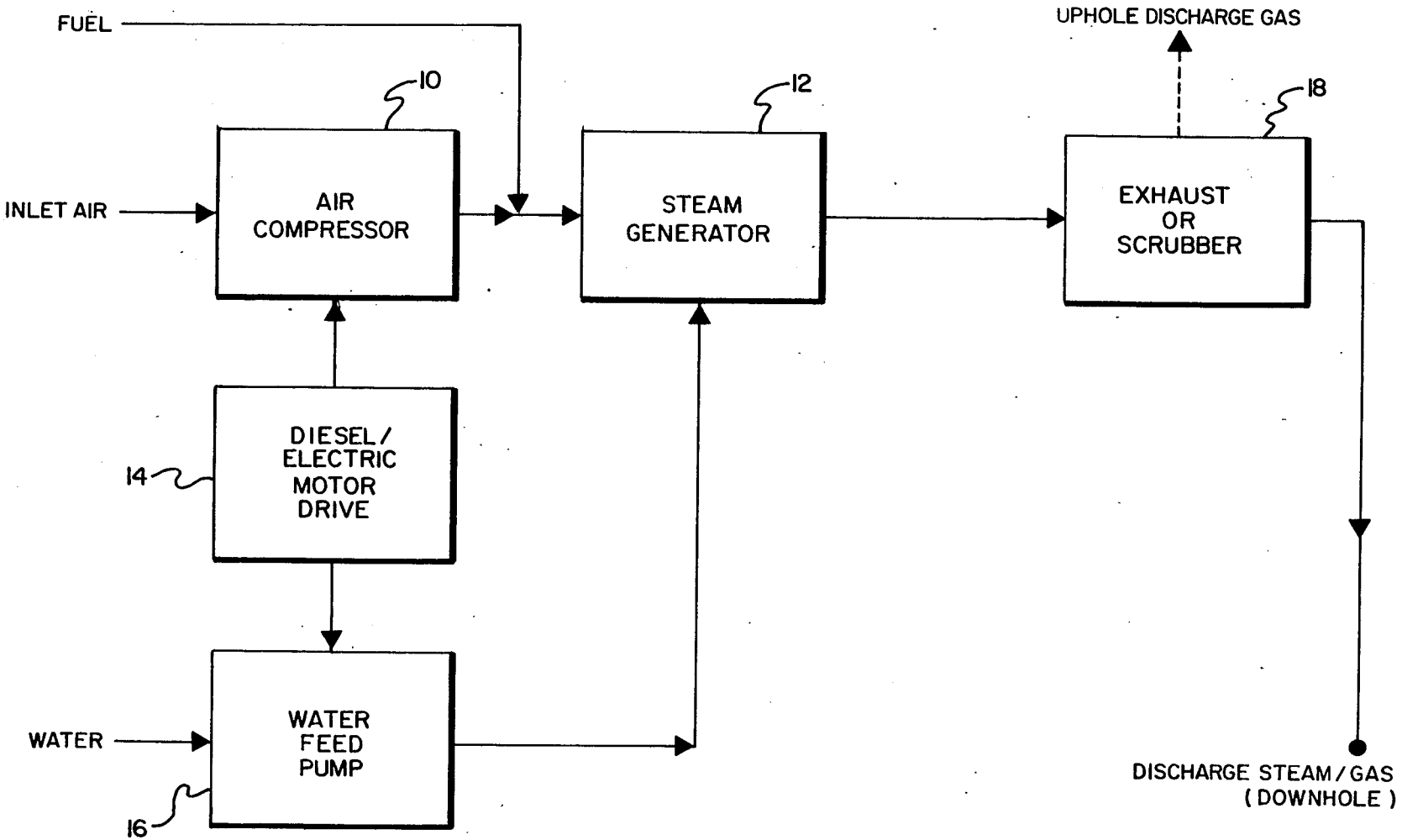
FIG. 1 is a block diagram showing a type of conventional, downhole, steam-generating system.

FIG. 1 shows, in block form, a conventional, downhole steam-generator system. Compressed air and fuel, which may be gas, oil, an oil-coal slurry, etc., are fed to a combustor in a steam generator 12. The air is first compressed by an air compressor 10 which is driven by a separate piece of equipment which may be a diesel engine or an electric motor 14, for example. The motor 14 is also used to drive the pump 16 which feeds water to the steam generator 12 where it is converted to steam. The steam and the combustion exhaust products are passed through a scrubber 18 and then the steam and exhaust gas are discharged in the hole (direct injection system) or the exhaust gases can be kept separated and discharged uphole (in the atmosphere); i.e., only the steam is sent downhole (indirect injection system).

Figure 2:
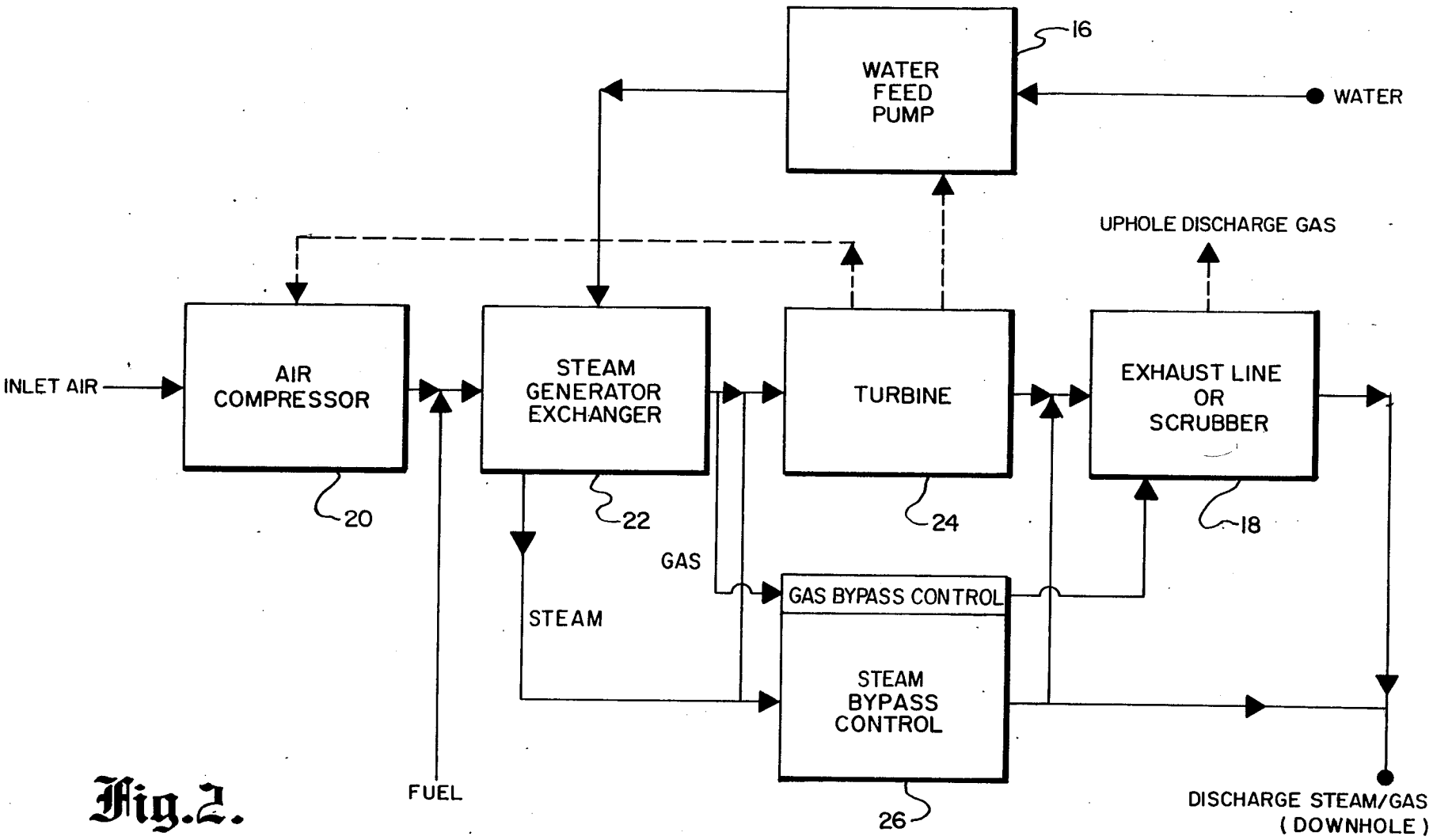
FIG. 2 is a block diagram illustrating an embodiment of a downhole steam-generating system according to the present invention.

FIG. 2 shows an embodiment of the present invention. Here the air compressor 20 delivers air to the steam generator unit 22, to which fuel and water are also delivered. The combustion of the fuel and compressed air generates the heat which changes the water to steam. The steam or the exhaust gases of the combustion process, or a combination of both, are used to drive a turbine 24 which is mechanically coupled to drive the air compressor 20, and also the water feed pump 16. The gas products, or the steam and gas products, from the turbine 24, are passed through a scrubber 18 and released downhole, or the gas products may be discharged uphole. A gas/steam bypass control unit 26 is used to regulate the relative amounts of the combustor gas products and steam delivered to the turbine 24 from the steam generator unit 22. With the gas/steam bypass control unit 26 in operation, an optimal collection of gas/steam mixture can be made depending upon the flow, temperature, and product demands of the well formation for steaming. The bypass control unit 26 may consist of a proportional valve unit, orifice-type device, electro-pneumatic control or hydraulic unit and should be located external to the steam generation exchanger 22 and turbine 24. In this invention, the driving energy for the air compressor is obtained from the turbine 24 which, in turn, is driven by the steam, or steam and gas products, of the steam generator 22. The water pump 16 is also generally driven by the turbine 24.

All components may be constructed as part of a single downhole package which is connected to air, fuel and water supply sources by piping. A small integral, high-speed turbine and air compressor unit may be employed thus reducing the size of the units and providing portability. This is necessary in the environment contemplated in which the bore holes are no larger than sixteen inches in diameter and typically range from 8–12 inches in diameter. Nearly all the heat and flow used to drive the turbine is also delivered downhole and not dissipated uphole as in most conventional designs for downhole steam generators. This reduces the amount of fuel required for the system. The benefits of the new system with respect to reducing the amount of fuel used for air compression depend greatly on the depth of the well and the amount of steam used for recovery. The amount of energy applied to produce steam may vary from one barrel consumed to three to six barrels recovered. Use of the turbocompressor thus can save up to 30% of the fuel used in conventional steam-generating systems for deep wells with direct injection. Costs will be reduced correspondingly.

Figure 3:
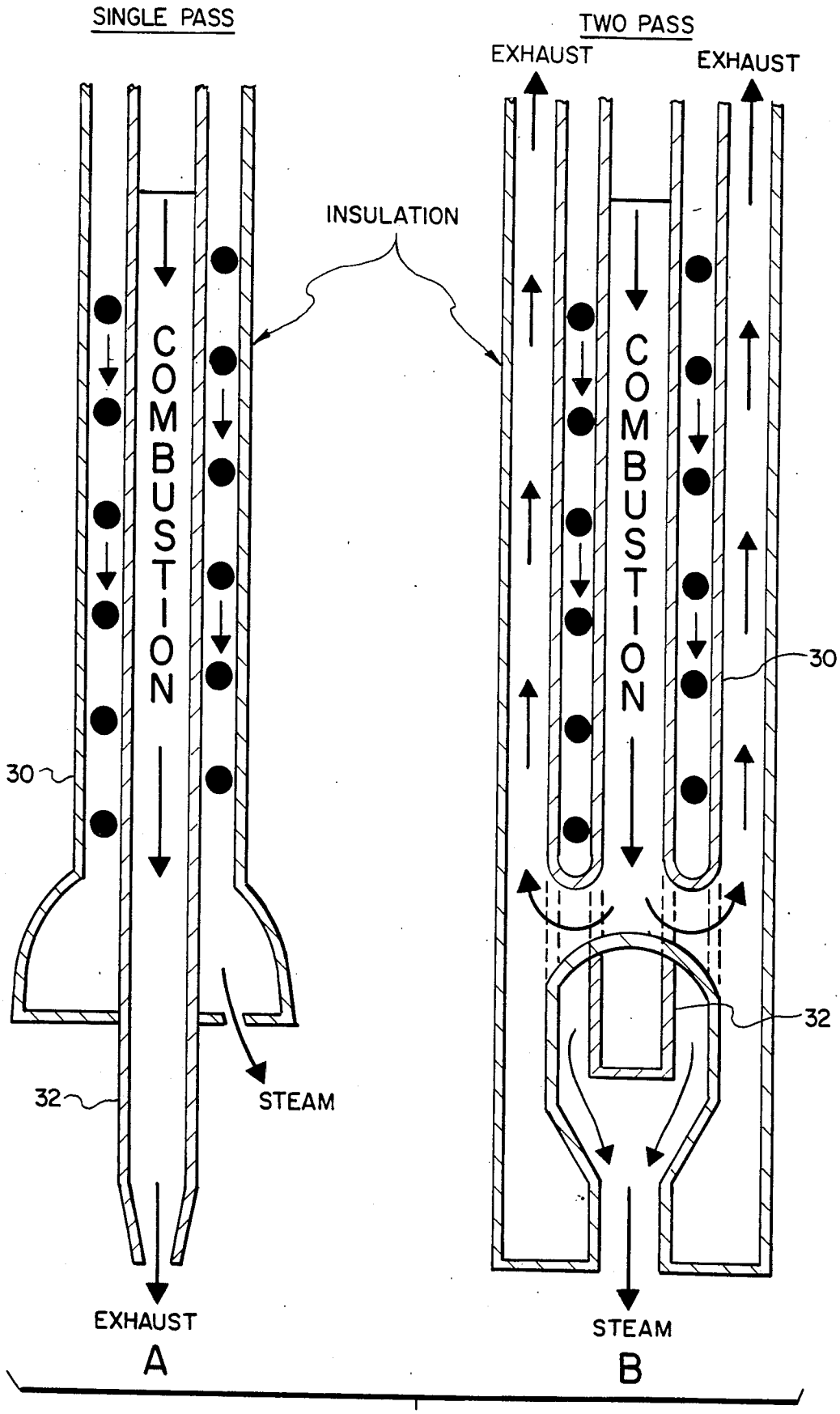
FIGS. 3A and 3B are schematic illustrations of single-pass and two-pass steam-generating units.

FIG. 3 shows, in schematic form, two forms of steam-generating units. In the single-pass unit (FIG. 3A), the steam-conversion means, or steam jacket 30, surrounds the combustor 32 and the water is passed only once along the combustor 32. The combustion exhaust products and the steam are delivered downward to the turbine unit. In the two-pass unit (FIG. 38), the water and steam make a single pass along the outer wall of the combustor 32 and are then delivered to the turbine. The combustion products pass through the combustor 32 and are then brought back upwards past the water/steam jacket 30 once more. The exhaust products can be passed through the turbine and a scrubber and discharged into the air or piped downwards to be delivered into the borehole with the steam. The advantage of the two-pass system is that the system generator can be made shorter, perhaps as much as one-half the length of the single-pass unit.

Figure 4:
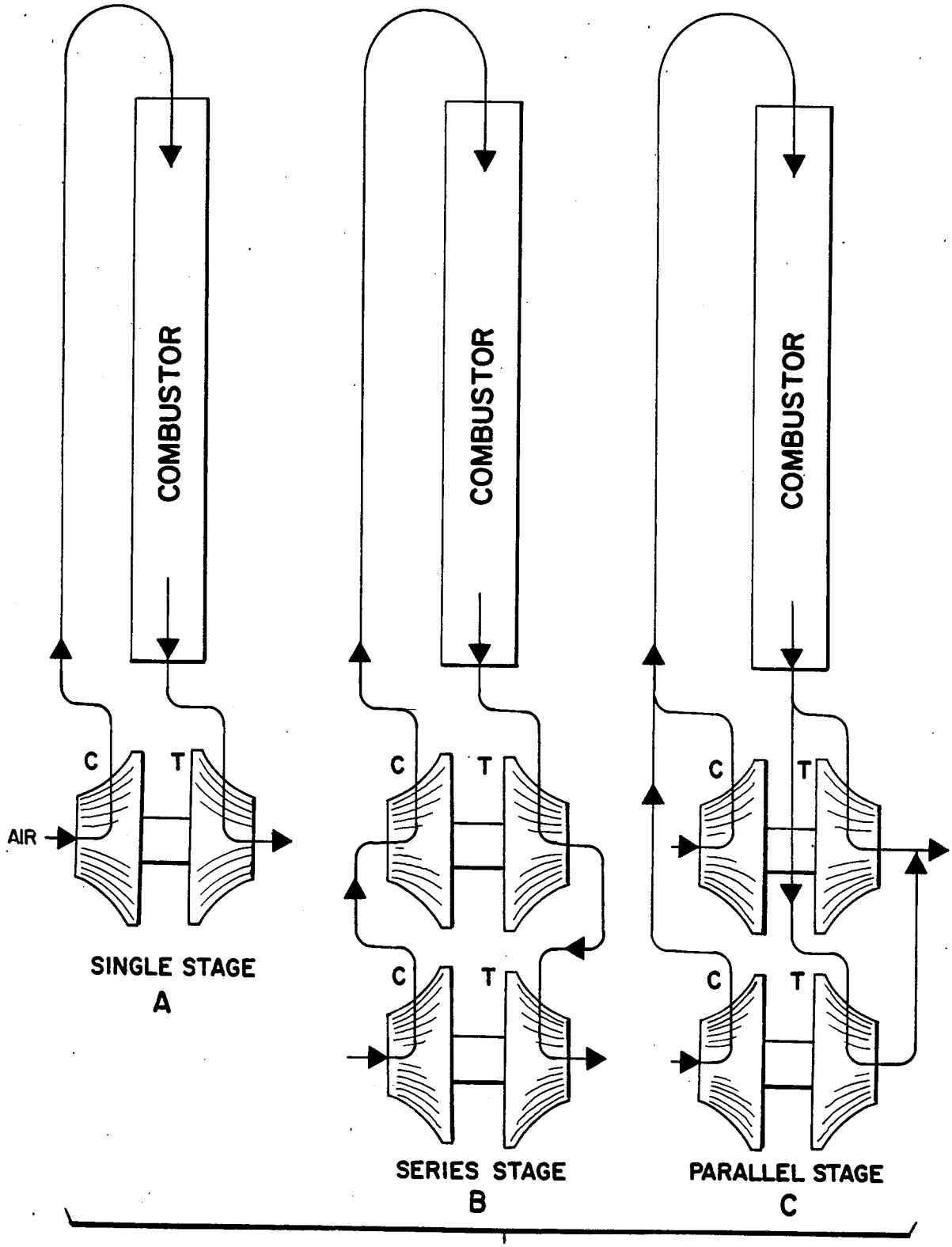
FIGS. 4A–4C are schematic illustrations of one-pass turbosteam unit variations.
Figure 5:
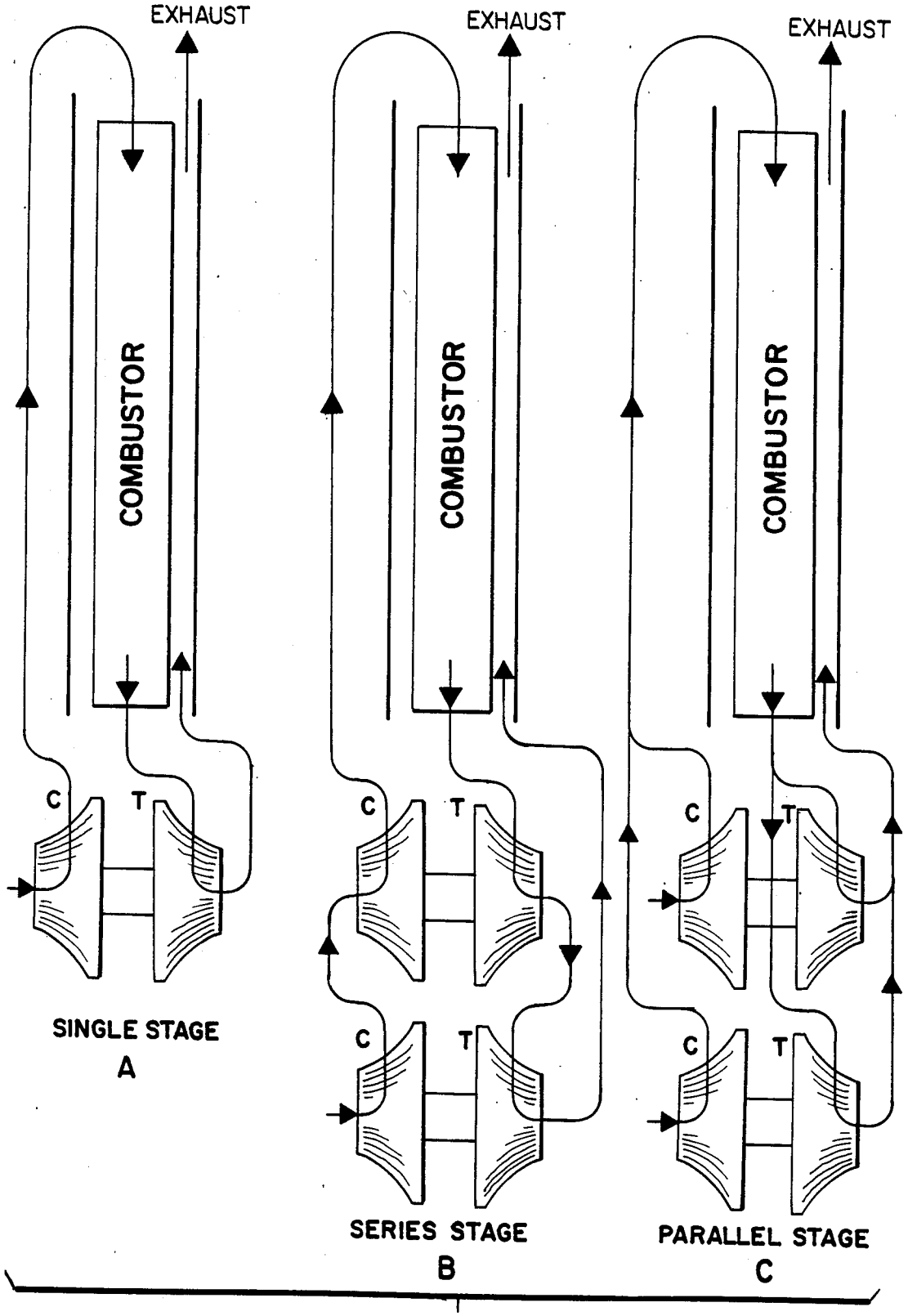
FIGS. 5A–5C are schematic illustrations of two-pass turbosteam unit variations with the turbines being fed before the second pass.
Figure 6:
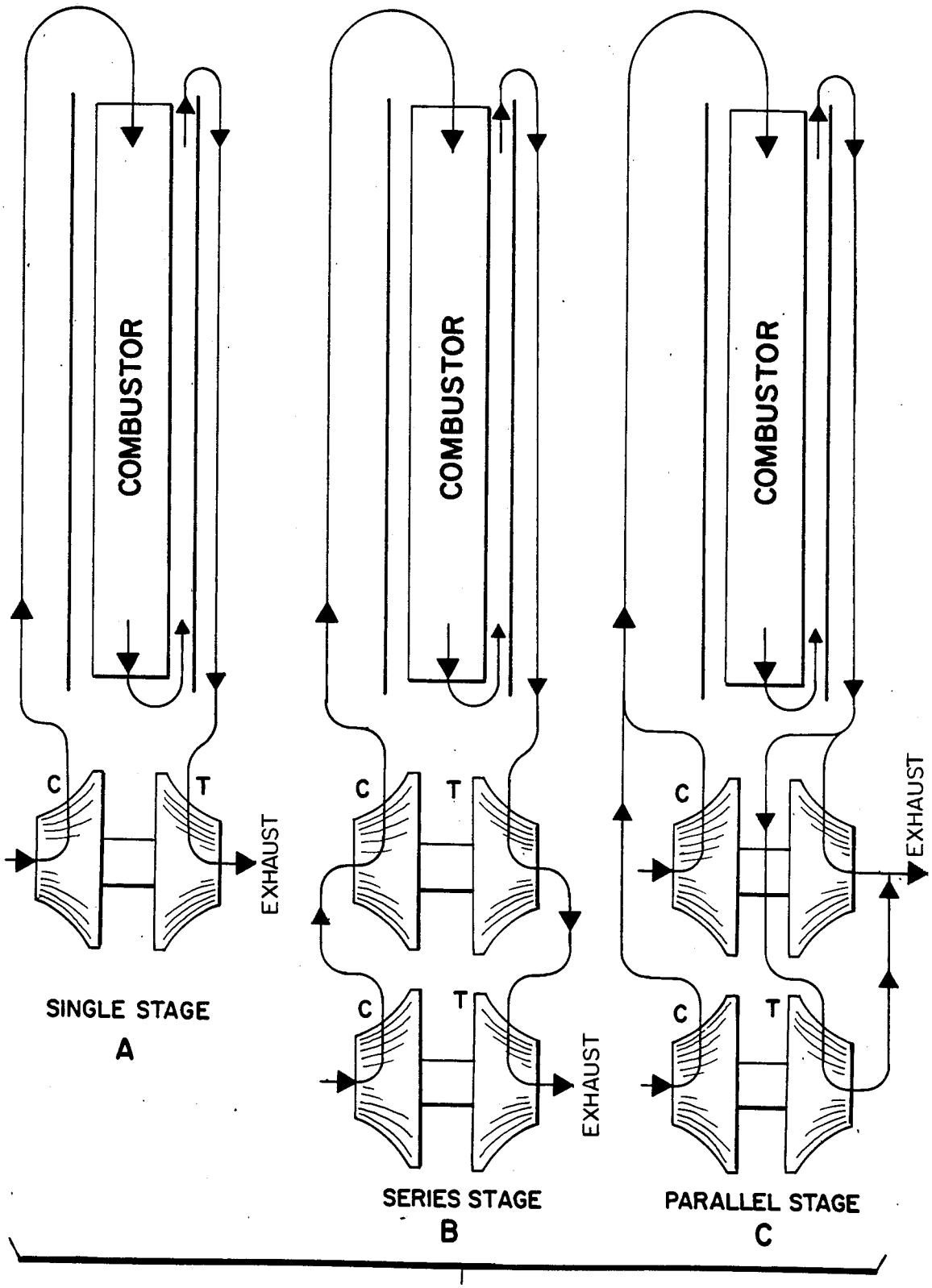
FIGS. 6A–6C are schematic illustrations of two-pass turbosteam unitvariations with the turbines being fed after the second pass.

Various systems for combining compressor, steam generator and turbine are shown schematically in FIG. 4, 5 and 6. FIG. 4 shows variations for a single compressor (C) and turbine (T) in a one-pass turbosteam unit. Air is fed to the compressor, delivered in compressed form to the combustor where it is burned with fuel, and the exhaust products are then passed through the turbine (T) and help to drive the air compressor. The steam produced by the heat of the combustor is not shown but it is to be understood that the steam may be passed through the turbine(s) whenever desired. FIGS. 4B and 4C indicate schemes for driving two compressors and two turbines in series and in parallel, respectively.

FIGS. 5A–5C show two-pass turbosteam units in which the combustor gases are fed to the turbine(s) before making the second pass along the steam jacket (not shown). FIGS. 6A–6C show two-pass turbosteam units in which the combustor gases are fed to the turbine(s) after making the second pass along the steam jacket (not shown). FIGS. 4, 5 and 6 are self-explanatory.

Figure 7:
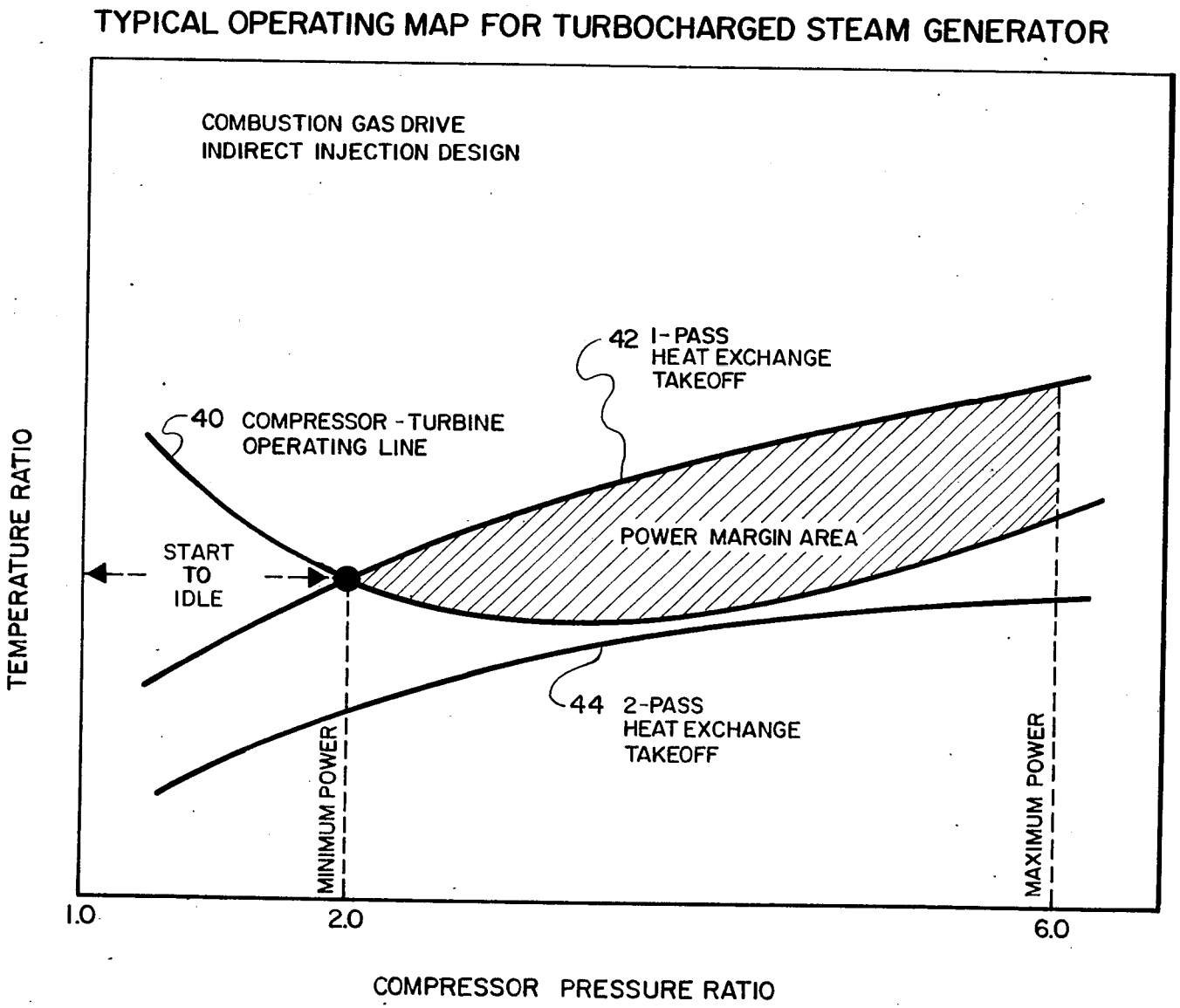
FIG. 7 is a typical set of curves showing one-pass heat exchange curve, a two-pass heat exchange curve, and a turbocompressor operating line, the usable area of operation being hatched.

FIG. 7 shows typical operating curves for a turbocharged steam generator where the temperature ratio is the dependent variable and the compressor pressure ratio is the independent variable. It can be seen that the two-pass system does not provide enough heat for compressor pressure ratios of 1–6 to operate the turbocompressor system. The graph is for combustion gas drive in an indirect injection system. Use of steam alone or steam combined with the combustion products, however, will result in an adequate power margin for drive because of the large steam pressure and flow available for powering the turbine.

Figure 8:
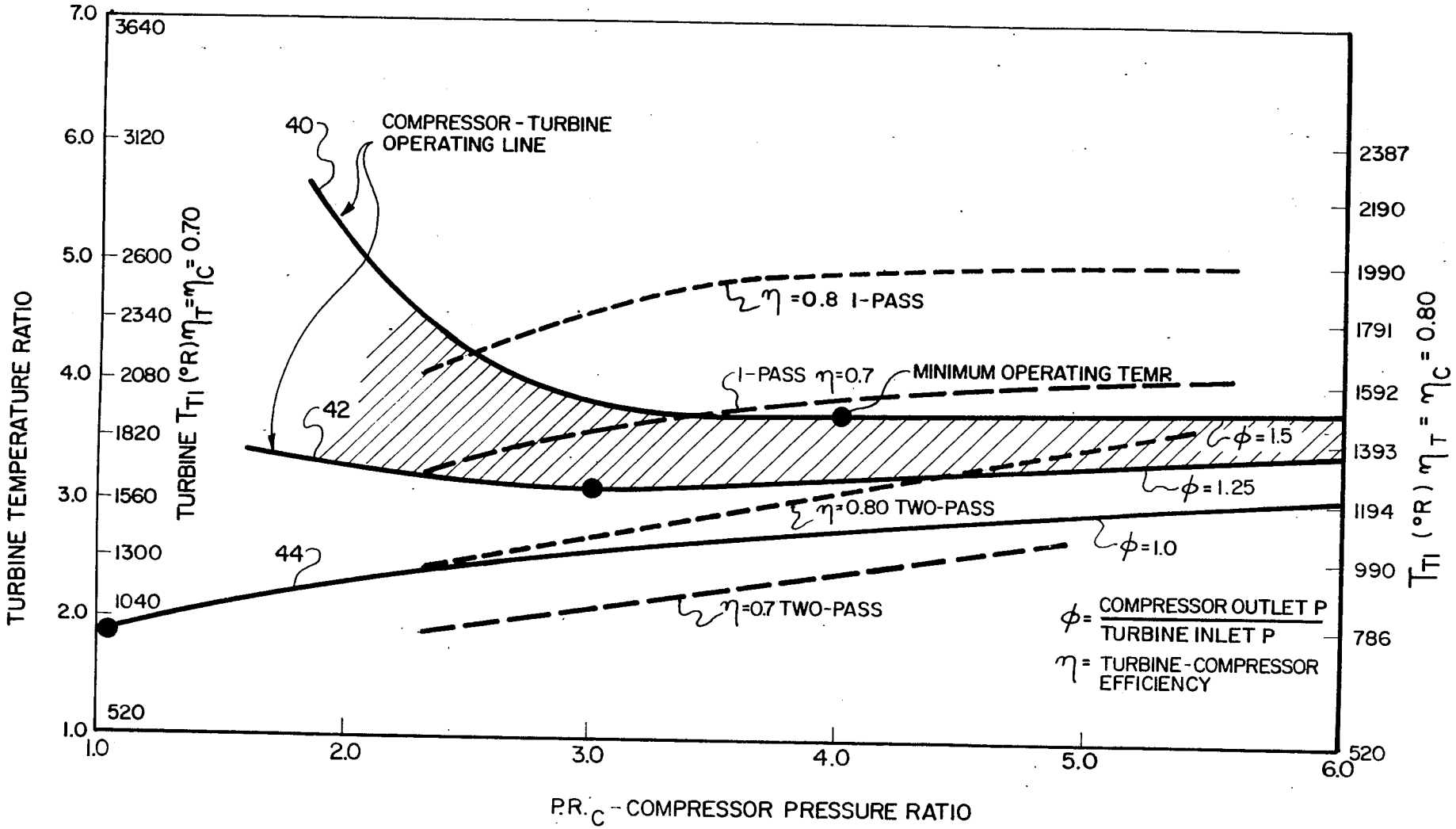
FIG. 8 is a typical set of operating curves for three turbocompressor units plotted in terms of both turbine temperature ratio and total turbine inlet temperature versus compressor pressure ratio.

FIG. 8 is a typical operating map, or set of curves, for the case of the exhaust combustor products alone driving the turbocompressor unit. The curves are in terms of turbine temperature ratio versus compressor pressure ratio for an indirect steam generator. It can be seen that the power band (hatched area) wherein the system is self-sustaining ranges from a pressure ratio of about two to about six for most steam generator uses. Selection of a one-pass combustion system would, in most cases, be best to provide a proper temperature for turbine drive purposes. Turbocompressor operating lines 40, 42, 44 are shown for $\phi$ ratios of 1.5, 1.25 and 1.0, respectively. The heavy dots on these lines indicate minimum turbine operating temperatures for each curve. The best operating region is the hatched region between the $\phi=1.5$ and $\phi=1.25$ lines and between compressor pressure ratios of about 2 to 6.

An integral turbocompressor unit may be employed with this invention or the two units may be separated. The important aspect of this invention is that the energy for driving the turbine is obtained from the combustor of the steam-generator unit and the turbine drives the air compressor, so that both the air compressor and the turbine derive their driving energy from the steam-generator's combustor products. Nearly all the energy derived from the combustion process is utilized, the heat dissipation losses being minor. Of course, the system shown in FIG. 2 cannot start itself, but must be started externally by driving the air compressor by means of a small electric motor, or by providing an initial charge of liquid oxygen and fuel to the combustor, or by feeding compressed air to the turbine from a supply tank, or by any other suitable means.

The portability of the present invention as operated as an integral turbocompressor unit makes this invention uniquely adapted for operating economically at great depths (i.e. as deep as 20,000 feet). Its utilization of the principle of indirect heat exchange allows for a compact unit with high steam pressure and relatively low combustion pressure for the demands of the well bore and turbine conditioning, respectively.

Although the bypass control 26 is located external the steam generator exchanger 22 and turbine 24 it is nevertheless integral therewith and is also sent down the bore hole. This control 26 is therefore instantaneously responsive to the turbine's inlet and outlet temperature and allows automatic control of turbine temperature and turbine flow rate.

Obviously, many modifications and variations of the present invention are possible in light of the above teachings. It is therefore to be understood that, within the scope of the appended claims, the invention may be practiced otherwise than as specifically described.

What is claimed and desired to be secured by U.S. Pat. Nos. is:

1. A downhole steam-generating system comprising:
an air compressor;
a steam generating unit, including:
a combustor for combusting fuel with the compressed air from said compressor thereby producing combustor exhaust products; and
steam conversion means, in indirect heat-exchange relationship with said combustor, for converting water which is fed into said steam-conversion means into steam;
a turbine which is rotated by said combustor exhaust products and steam from said steam-generating unit, the rotational motion of the turbine being mechanically coupled to the air compressor to drive said air compressor; and
control bypass means associated with said steam generating unit and turbine for regulating the relative amounts of the combustor exhaust product and steam delivered to said turbine from said steam generating unit,
wherein said air compressor and turbine form an integral turbocompressor unit, said turbocompressor unit, steam-generating unit and control bypass means being located downhole during operation of the steam-generating system.

2. A system as in claim 1, wherein: said turbine is a high-speed turbine.

* * * * *